US010240342B2

(12) United States Patent
van de Bult et al.

(10) Patent No.: US 10,240,342 B2
(45) Date of Patent: Mar. 26, 2019

(54) BUILDING PANEL FOR CEILINGS OR WALLS

(71) Applicant: Hunter Douglas Industries B.V., Rotterdam (NL)

(72) Inventors: Bart van de Bult, Bergschenhoek (NL); Michiel Jacobus Johannes Langeveld, Zoetermeer (NL)

(73) Assignee: Hunter Douglas Industries B.V., Rotterdam (NL)

( * ) Notice: Subject to any disclaimer, the term of this patent is extended or adjusted under 35 U.S.C. 154(b) by 201 days.

(21) Appl. No.: 14/628,418

(22) Filed: Feb. 23, 2015

(65) Prior Publication Data

US 2015/0240491 A1 Aug. 27, 2015

(30) Foreign Application Priority Data

Feb. 24, 2014 (NL) ..... 1040682

(51) Int. Cl.
*E04C 2/38* (2006.01)
*E04C 2/292* (2006.01)
(Continued)

(52) U.S. Cl.
CPC ..... *E04C 2/38* (2013.01); *E04C 2/292* (2013.01); *E04C 2/365* (2013.01); *E04C 2/46* (2013.01);
(Continued)

(58) Field of Classification Search
CPC ... E04C 2/38; E04C 2/46; E04C 2/365; E04C 2/292; E04C 2002/001; E04C 2002/004; E04C 2002/3444; E04C 2002/3488; E04C 2/296; E04C 2/30; E04C 2/32; E04C 2/324; E04C 2/36; E04F 13/09; E04F 13/077; E04F 13/0866; E04F 13/00; E04F 13/07; E04F 13/072; E04F 13/0889; E04F 13/0886; E04F 13/005; E04F 13/0801; E04F 13/0803; E04F 13/081; E04F 13/0819; E04F 13/082; E04F 13/0823;
(Continued)

(56) References Cited

U.S. PATENT DOCUMENTS 2,944,622 A 7/1960 Dobbins
3,916,577 A * 11/1975 Vare ..... E04B 2/58 52/506.1
(Continued)

FOREIGN PATENT DOCUMENTS

DE 29821295 U1 3/1999
GB 2036827 7/1980
(Continued)

*Primary Examiner* — Jessica L Laux
(74) *Attorney, Agent, or Firm* — Dority & Manning, P.A.

(57) ABSTRACT

A building panel for a wall or ceiling is provided. The panel comprises a first plate forming a front of the panel, a second plate forming a rear of the panel, and a core structure positioned between the first plate and the second plate and being adhesively bonded to the first plate and the second plate. The panel further comprises an attachment member for attaching the panel to a wall or ceiling or to a structure attached to a wall or ceiling, and a mechanical fastening device which extends between and mechanically fastens the first plate to the second plate and/or the attachment member.

25 Claims, 6 Drawing Sheets

(51) Int. Cl.

| | |
|---|---|
| ***E04C 2/36*** | (2006.01) |
| ***E04B 2/00*** | (2006.01) |
| ***E04F 13/077*** | (2006.01) |
| ***E04F 13/09*** | (2006.01) |
| *E04B 9/04* | (2006.01) |
| *E04B 9/24* | (2006.01) |

(52) U.S. Cl.
CPC ..... *E04F 13/077* (2013.01); *E04F 13/09* (2013.01); *E04B 9/0442* (2013.01); *E04B 9/0478* (2013.01); *E04B 9/0485* (2013.01); *E04B 9/247* (2013.01)

(58) Field of Classification Search
CPC ..... E04F 13/0825; E04F 13/0826; E04F 13/0835; E04F 13/0839; E04F 13/0846; E04F 13/0864; E04F 13/0894; E04B 9/0478; E04B 9/247; E04B 9/0485; E04B 9/064; E04B 9/0442; E04B 9/04; E04B 9/0435; E04B 9/0464; B32B 7/08; B32B 7/12
See application file for complete search history.

(56) References Cited

U.S. PATENT DOCUMENTS 5,522,193 A * 6/1996 Sommerstein ..... E04F 13/081 52/235
5,740,650 A * 4/1998 Seiber ..... A47B 57/425 403/297
6,070,383 A * 6/2000 Jeanseau ..... E04B 9/02 454/187
7,322,157 B2 * 1/2008 Hang ..... E04B 9/003 248/322
2004/0055239 A1 3/2004 Hang
2004/0055248 A1 * 3/2004 Grillos ..... B64C 1/12 52/783.1
2005/0188626 A1 * 9/2005 Johnson ..... E04B 2/7412 52/144
2006/0053715 A1 * 3/2006 Mowery ..... E04F 13/0864 52/309.8
2006/0137280 A1 * 6/2006 Bartnes ..... E04F 15/02 52/582.2
2006/0265988 A1 * 11/2006 Fujito ..... E04F 13/0889 52/511
2009/0025335 A1 * 1/2009 Flynn ..... E04C 2/292 52/792.11
2009/0031652 A1 * 2/2009 Ortega Gatalan .... E04F 13/081 52/235
2010/0229484 A1 * 9/2010 Carolan ..... E04C 2/292 52/302.1
2012/0216476 A1 * 8/2012 Naidoo ..... E04B 1/14 52/309.4
2012/0231231 A1 * 9/2012 Curtin ..... E04C 2/292 428/192
2012/0304575 A1 * 12/2012 Vakhnin ..... E04B 9/068 52/506.07
2013/0067838 A1 * 3/2013 Black ..... E04C 2/22 52/220.7
2013/0104478 A1 * 5/2013 Meersseman ..... E04F 13/0894 52/309.1
2013/0136888 A1 * 5/2013 Rhee ..... B32B 3/12 428/83
2014/0093677 A1 * 4/2014 Permesang ..... E04F 15/02038 428/99

FOREIGN PATENT DOCUMENTS

GB 2337776 1/1999
WO 2008077563 A1 7/2008

* cited by examiner

BUILDING PANEL FOR CEILINGS OR WALLS

CROSS-REFERENCE TO RELATION APPLICATION

This application claims priority to Netherlands Patent Application No. 1040682, filed on Feb. 24, 2014, and entitled "Building panel for Ceilings or Walls", which is hereby incorporated by reference herein in its entirety for all purposes.

FIELD

The present invention relates to a building panel for use on a wall or a ceiling, and more particularly to building panels formed from adhesively bonding several layers together to form the building panel.

BACKGROUND

Building panels including a front plate, a rear plate and a core structure adhesively bonded to and sandwiched between the plates are known in the art. Such building panels may be found, for example, in the interior of buildings on walls and ceilings, or on the walls and ceilings of underground railway stations. The panels may serve to enhance the aesthetic, insulating and/or acoustic properties of the building. Depending on the panel's function, the front and/or rear plate may be provided with apertures. The core structure may be formed from honeycomb material and/or a foamed material, such as rock wool or the like.

The front plate and the rear plate each have two main surfaces, namely an interior surface which is bonded to the core structure and an exterior surface. One or each interior surface may be provided with one or more layers of non-woven fabric. The exterior surface of the rear plate is intended to face a wall or ceiling and hence, when the panel is installed on a wall or ceiling, is not visible to people inside the building. However, the exterior surface of the front plate faces outwardly and is visible to people inside the building as they view the wall or ceiling. It is therefore desirable that the exterior surface of the front plate is aesthetically appealing.

Adhesively bonding the individual elements of the building panel together allows a panel to be rapidly and inexpensively assembled, and provides a building panel having an aesthetically acceptable visible front surface, free from bolts, rivets or the like.

However, when adhesively bonded building panels are subjected to extremely hot environments, such as, for example, during a fire in the building or underground railway station in which the panels are installed, the heat may cause the adhesive to melt, incinerate or otherwise disintegrate so as to loose its adhesive properties, resulting in the constituent parts of the panel separating. Where the building panels are located on the ceiling or high up on a wall, these constituent parts of the panel may fall onto firefighters or people trying to evacuate the building, causing injury. The present invention addresses this problem.

SUMMARY

According to the present invention there is provided a building panel for a wall or ceiling comprising:

a first plate forming a front of the panel;

a second plate forming a rear of the panel;

a core structure positioned between the first plate and the second plate and being adhesively bonded to the first plate and the second plate;

an attachment member for attaching the building panel to a wall or ceiling or to a structure attached to a wall or ceiling; and at least one mechanical fastening device which extends between and mechanically fastens the first plate to the second plate and/or the attachment member.

The present invention thereby permits adhesively bonded panels to be used in buildings, underground railway stations, etc. without risk that the panels will fall apart when subjected to high heat. By providing a mechanical fastening device which extends between and mechanically fastens the first plate to the second plate and/or the attachment member, the first plate (which includes the front face of the panel) is prevented from becoming detached from the remainder of the panel due to melting, decomposing or otherwise failing of the adhesive bond between the first plate and the remainder of the panel, and is thereby prevented from falling from a wall or ceiling and causing injury.

The mechanical fastening device is preferably designed and/or positioned such that it is not visible to a viewer looking at the front (i.e. the exterior surface of the first plate) of the building panel.

The mechanical fastening device may be or comprise a wire, a hook, a pin, a nail, a screw, a rivet, a peg, or a similar object capable of mechanically connecting and fastening the first plate to the second plate and/or the attachment member.

The attachment member is preferably adhesively bonded to one or both of the first plate and the second plate. The attachment member is preferably bonded to an interior surface of the first plate such that it is not visible to a viewer looking at the front (i.e. the exterior surface of the first plate) of the panel. The second plate is preferably smaller than the first plate, such that the second plate does not extend fully over the attachment member.

The attachment member preferably extends along an edge of the panel and preferably comprises slots or grooves configured to receive a rail or runner of a complementary attachment device located on a wall, a ceiling or a structure suspended from or attached to a wall or ceiling, thereby enabling mounting of the panel. Advantageously, the panel comprises two attachment members extending along two opposing edges of the panel.

The first and/or second plate may have a plurality of apertures formed therethrough. The mechanical fastening device may comprise a wire which extends between the first plate and the second plate and which is looped through apertures in the first and second plates to mechanically connect and fasten the first plate to the second plate.

The attachment member may comprise one or more apertures for receiving a wire extending between the first plate and the attachment member to mechanically connect and fasten the first plate to the attachment member.

Advantageously, the first plate is bent so as to form a front face of the panel and at least one side face of the panel, the side face of the building panel extending substantially perpendicular to the front face of the building panel. Most preferably the wire extends between that part of the first plate forming a side face of the building panel and the second plate and/or the attachment member.

Alternatively the attachment member and/or the second plate may be provided with a wire holding device for receiving a wire extending from the first plate. The wire holding device may be configured to grip the wire tightly, or may be a reel around which the wire can be wound, for example. The wire holding device may be formed integrally with, or attached to, the attachment member or second plate.

Instead of or in addition to a wire, a hook may be used to mechanically attach the first plate to the second plate and/or the attachment member. The hook may be configured to hook into one or more apertures of the first plate and/or the second plate and/or the attachment member, or an eyelet may be provided on the first plate and/or the second plate and/or the attachment member for receiving the hook.

Additionally or alternatively the mechanical fastening device may be a mechanical fastener such as a pin, rivet, screw, nail or peg, for example. The mechanical fastener preferably extends between and mechanically fastens the first plate to the attachment member. Most preferably the mechanical fastener extends between that part of the first plate forming a side face of the panel and the attachment member.

A recess, hole or groove may be provided in the attachment member for receiving the mechanical fastener. The mechanical fastener may comprise a threaded portion. The recess, hole or groove may have a complementary thread to the mechanical fastener, or may be formed from a material which is not as hard as the mechanical fastener, so that, when a threaded fastener is inserted and screwed into the recess, hole or groove the threaded fastener creates a complementary thread therein, thereby mechanically fastening the attachment member to the first plate. Alternatively, the mechanical fastener may have a smooth shank and the recess, hole or groove may be sized to receive and tightly grip a mechanical fastener inserted therein. A hole is advantageously provided in the first plate for receiving the mechanical fastener. Preferably the recess, hole or groove provided in the attachment member extends along the longitudinal direction of the attachment member.

Advantageously, the building panel comprises two attachment members extending along two opposing edges of the panel, and four mechanical fasteners extending between and mechanically coupling the first plate to the attachment members, two mechanical fasteners being provided for each attachment member and being located at opposite longitudinal ends of the attachment member.

The first and/or second plates of the building panel may further include one or more layers of a nonwoven fabric or a foil, e.g. a micro perforated foil, for enhancing the same absorption properties of the panel. Preferably a nonwoven fabric layer or foil is adhesively attached to the interior surface of the first plate and/or the interior surface of the second plate prior to bonding the first and second plates to the core structure.

BRIEF DESCRIPTION OF THE DRAWINGS

The present invention will now be described by way of example only with reference to the accompanying drawings, or which.

DETAILED DESCRIPTION

Figure 1:
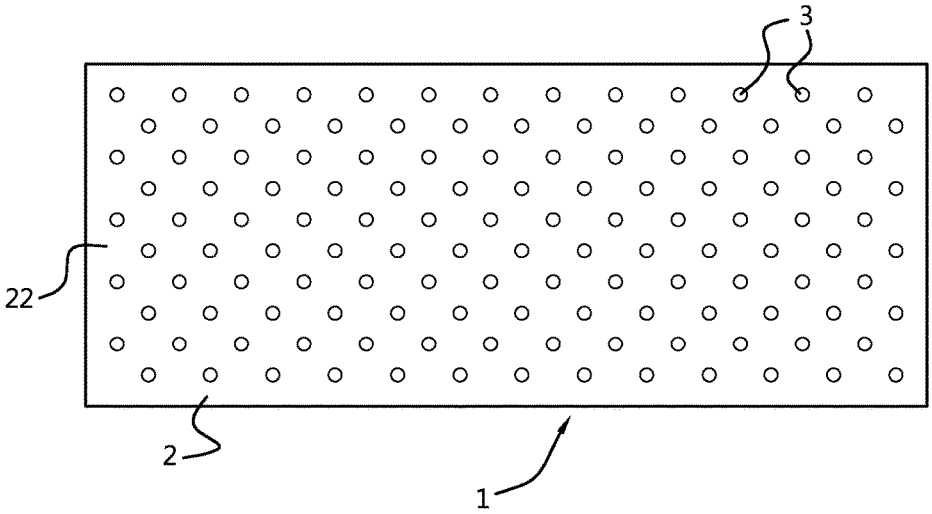
FIG. 1 shows a plan view of the front of a building panel in accordance with the present invention.

FIGS. 1 to 5 show different views of an embodiment of a building panel 1 in accordance with the present invention. FIG. 1 shows the front face 22 of the building panel 1. The front face 22 is formed from a first plate 2. The plate 2 may be formed, for example, from aluminium, or from any other suitable material. In the illustrated embodiment, the first plate 2 has a plurality of apertures 3 formed therein. Depending on the desired acoustic properties, these apertures 3 may for instance have a diameter of around 1.5 mm and be positioned at a pitch of about 3 to 4 mm. The combined surface of the apertures 3 may for instance cover from about 20% to 25% of the total exterior surface 13 of the first plate 2. In an alternative embodiment, the first plate 2 may comprise no apertures, as depicted in FIGS. 7 to 10.

Figure 2:
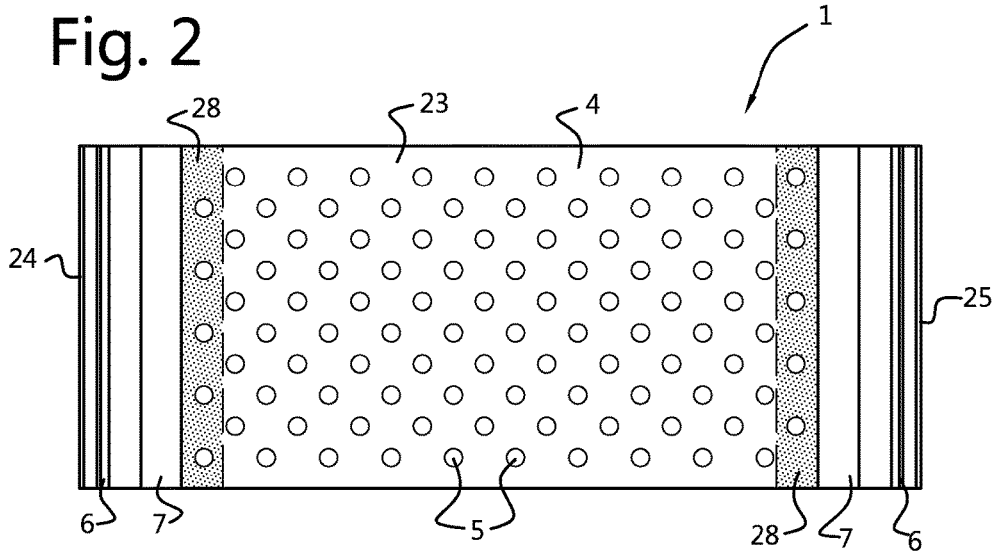
FIG. 2 shows a plan view of the rear of the building panel of FIG. 1.

FIG. 2 shows the rear face 23 of the building panel 1 depicted in FIG. 1. The rear face of the building panel 1 is formed from a second plate 4. The second plate 4 may be formed, for example, from aluminium, or from any other suitable material. An attachment member 6 extends along the edges 24 and 25 of the building panel 1. The attachment member 6 is adhesively bonded to the interior surface 14 of the first plate 2. The second plate 4 extends across and overlaps with part of the attachment member 6, the overlap between the second plate 4 and the attachment member 6 being identified as reference numeral 28 on the drawings. The second plate 4 is adhesively bonded to the attachment member 6 at the overlap 28. The attachment member 6 is not visible to a viewer looking at the front (i.e. the exterior surface 13 of the first plate 2) of the building panel 1. The attachment member 6 allows the building panel 1 to be mounted onto a wall or ceiling. The wall or ceiling on which the building panel 1 is to be mounted can be provided with a rail, rod, runner or similar structure on which the building panel can be mounted. The attachment member 6 comprises slots or grooves 7 which are dimensioned to receive the rod, rail or runner mounted to the ceiling or wall, thereby enabling the building panels to be mounted. As can be seen from FIG. 2, the building panel 1 comprises two attachment members 6 located near opposite edges 24, 25 of the building panel 1, and extending parallel to each other.

Figure 3:
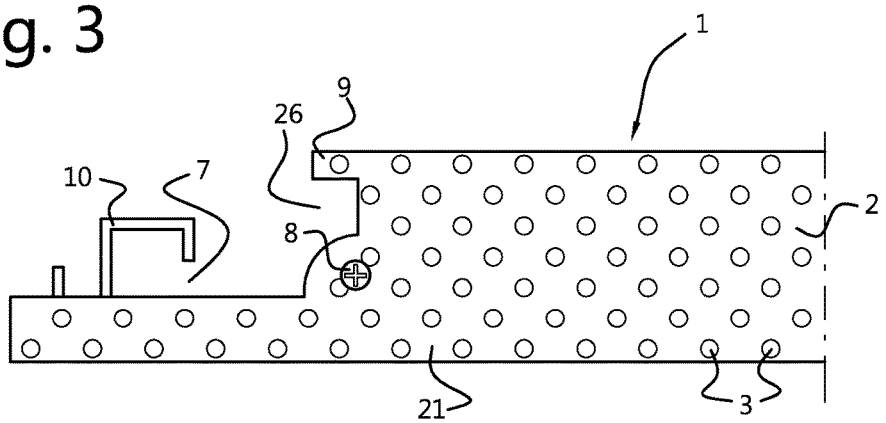
FIG. 3 shows a side view of the building panel of FIG. 1.

In this example, the second plate 4 is also perforated. It comprises a plurality of apertures 5 which are of a larger size than the apertures 3 of the first plate 2. Alternatively, depending on the intended use of the building panel 1, the second plate 4 may comprise no apertures, as depicted in FIGS. 7 to 10, or may comprise apertures of a similar or smaller size than the apertures 3 of the first plate 2. In this example, as can be seen in FIG. 3, the building panel 1 has a side 21 which extends perpendicular to the longitudinal direction of the attachment members 6. The side 21 of the building panel 1 is formed by bending a portion of first plate 2 through approximately 90°. To enable access to the attachment member 6 during mounting of the building panels, a portion 26 of the side 21 of the building panel 1 has been removed.

As can be seen in FIG. 3, the attachment member 6 comprises a groove 7, a flange 9 and an overhanging portion 10 configured to receive and retain a (portion of) a structure that is mounted on a wall or ceiling, such as a rail, runner or the like (not shown). The building panel 1 further comprises a mechanical fastener 8 which extends through a hole 27 (visible in FIGS. 7 and 8)—provided in the side 21 of building panel 1 into a recess, hole or groove provided in the attachment member 6. In this example, the mechanical fastener 8 comprises a head 29 which is larger than the size of the hole 27 provided in the side 21 of the building panel 1, but which is sufficiently small so that it does not protrude greatly beyond the side 21 of building panel 1, thereby enabling building panels to be more closely arranged together, e.g. to improve the acoustic quality of the room in which the building panels are installed and/or to maintain the aesthetic qualities of the building panels.

Figure 4:
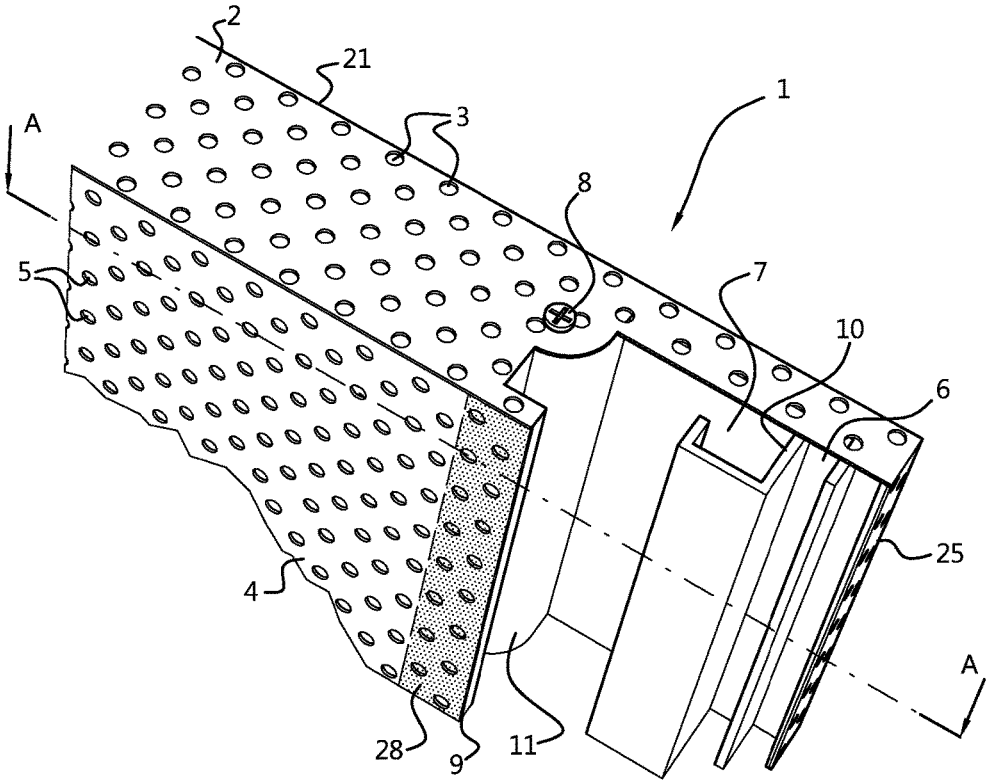
FIG. 4 shows a partial isometric view of a corner of the building panel of FIG. 1.

FIG. 4 shows an isometric view of the corner of the building panel 1 as viewed from the rear of the building panel. The attachment member 6 can be seen extending longitudinally along the edge 25 of building panel 1. The attachment member 6 includes a rounded housing 11 in which a bore is provided for receiving the shank of the mechanical fastener 8.

Figure 5:
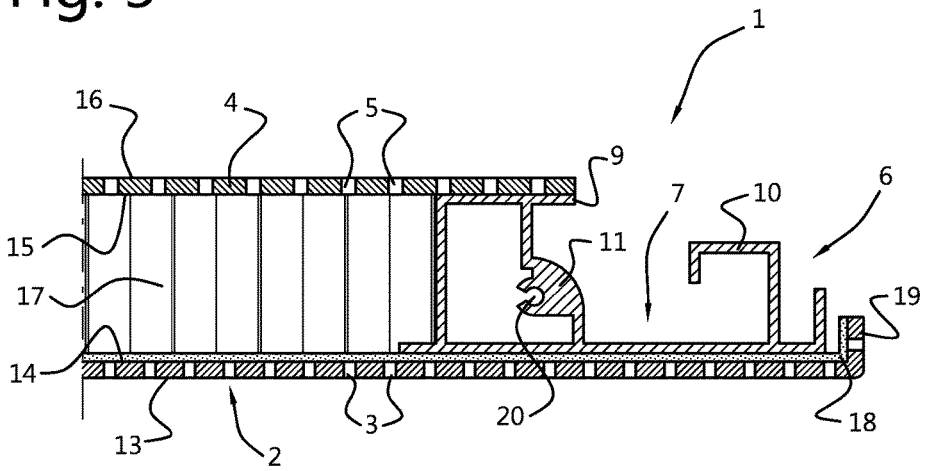
FIG. 5 shows a cross-section through the corner of the building panel depicted in FIG. 4 along the line A-A.

FIG. 5 shows a cross-section through the line A-A as marked on FIG. 4. For ease of understanding, FIG. 5 does not show the fastener 8. As can be seen in FIG. 5, the building panel 1 is formed from a variety of components adhesively bonded together. The building panel 1 comprises first plate 2 having apertures 3 formed therein, the first plate 2 forming the front face 22 of the building panel 1. In this example, the first plate 2 includes, adhesively bonded to its interior surface 14, a nonwoven fabric layer 18. This nonwoven fabric layer 18 is optional, and may extend over part or all of the interior surface 14 of the first plate 2. Instead of or additional to the nonwoven fabric layer 18, several nonwoven fabric layers may be provided or one or more foil layers, wherein the foil is preferably provided with micro perforations. One or more similar layers (nonwoven fabric 18 and/or micro perforated foil) may be adhesively bonded along part or all of the interior surface 15 of the second plate 4 (not shown). A core structure 17 is adhesively bonded to the first plate 2 and the second plate 4, and extends between and is sandwiched between plates 2 and 4. In this example, the core structure is formed of a honeycomb material, e.g. of aluminium. Alternatively or additionally, the core structure may be formed from a foamed material, such as rockwool. In this example, the second plate 4 comprises a plurality of apertures 5 having a greater size than those of apertures 3 of the first plate 2. However, as explained above, the apertures 5 are optional and may be the same size as or be smaller than the apertures 3 of the first plate 2. When the building panel 1 is mounted, the exterior surface 13 of the first plate 2 forms the front face 22 of the building panel 1, which is exposed to the view of people in the room where the building panels are mounted. The exterior surface 16 of the second plate 4 is mounted to be adjacent to the wall or ceiling, and is therefore not visible to people in the room.

In this example, the first plate 2 comprises a second bent portion 19 which extends perpendicular to the front face 22 of the building panel and perpendicular to the side 21 of the building panel in which the fastener 8 is located. It can be seen from FIG. 5 that the side 19 of the building panel formed from the first plate 2 does not extend as far in a direction perpendicular to the front face 22 of the building panel 1 in comparison with the side 21 of the building panel. Again, this is to facilitate access to the attachment member 6 during mounting of the building panel 1.

The cross-section of the attachment member 6, including groove 7, flange 9 and overhanging portion 10 can be seen in FIG. 5. Furthermore, the recess, hole or groove 20 for receiving the fastener 8 can also be seen. In this example, the housing 11 which defines the recess, hole or groove 20 has a crescent-shaped cross-section, however, a circular or other shaped cross-section could be provided instead.

The recess, hole or groove 20 may be threaded. In this case, the fastener 8 also has a complementary thread on its shank. Alternatively, the shank of the mechanical fastener 8 may be threaded, but instead the housing 11 may be formed from a material having a hardness less than that of the mechanical fastener, so that, when a threaded fastener is inserted and screwed into the recess, hole or groove 20, the threaded fastener 8 creates a complementary thread therein, thereby mechanically fastening the attachment member to the first plate. Alternatively, the mechanical fastener 8 may have a smooth shank, and the recess, hole or groove 20 will then be configured to receive and tightly grip the mechanical fastener. In this example, the recess, hole or groove 20 extends along the length of the attachment member 6. As a result, a second mechanical fastener 8 can be provided at the other end of the attachment member. In this example, the building panel 1 comprises two attachment members 6 extending along opposing edges 24, 25 of the building panel 1, the attachment members running parallel to each other. In total, four mechanical fasteners are provided, one for each end of each of the attachment members 6. This ensures that the building panel 1, which may be relatively large (in the order of 1.2 m×2.5 m up to 1.6 m×6 m) has a first plate 2 which is firmly secured to the rest of the building panel, such that, even if the adhesive bonding within the building panel fails, the first plate 2 of the building panel will not fall.

Figure 6:
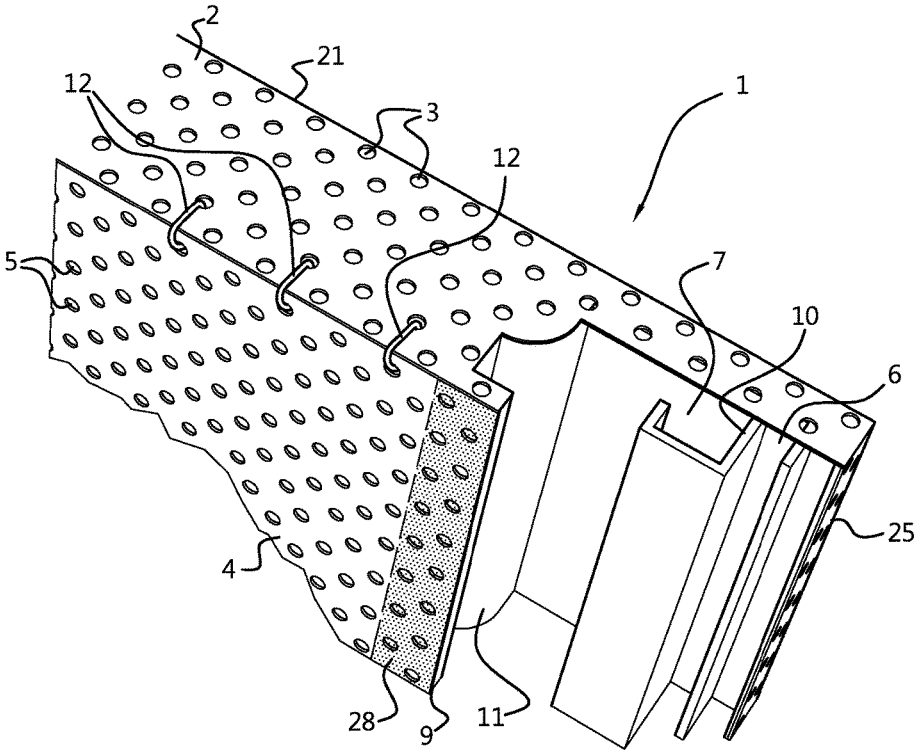
FIG. 6 shows a partial isometric view of a corner of a building panel in accordance with a further embodiment of the present invention.

FIG. 6 shows an alternative embodiment of the invention. In this case, a building panel 1 similar to that as depicted in FIGS. 1-5 is provided, however, this building panel 1 does not have a mechanical fastener 8, nor a housing 11 with recess, hole or groove 20 for receiving such a mechanical fastener. Instead, the mechanical fastening device comprises a wire 12, which is used to secure the first plate 2 to the second plate 4. As shown in FIG. 6, the wire 12 is passed through and looped between an aperture 3 located on side 21 of the first plate 2 of the building panel and an aperture 5 located on the second plate 4 of the building panel. The wire 12 may be looped between one or more apertures 3, resp. 5 on each plate 2, resp. 4 to mechanically fasten and secure plates 2 and 4 together. A plurality of wires 12 may be used to mechanically fasten plates 2 and 4 together.

Figure 7:
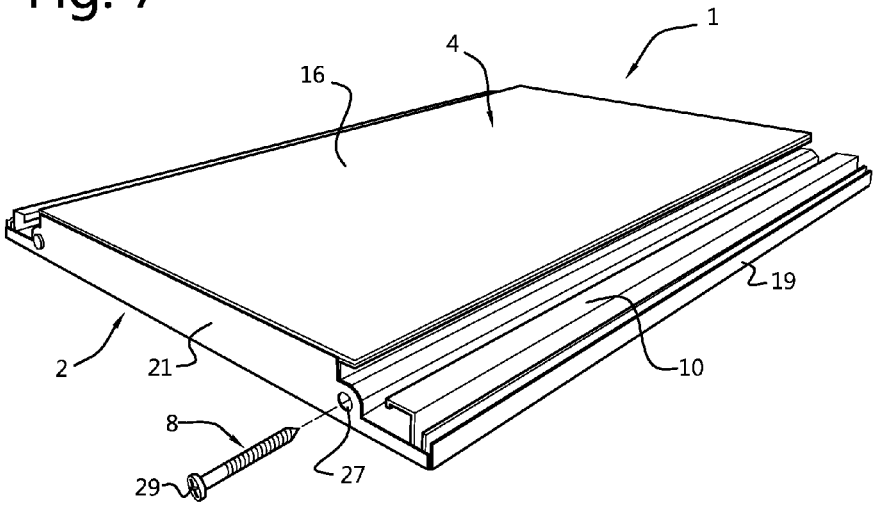
FIG. 7 shows an isometric view of a building panel in accordance with a further embodiment of the present invention.
Figure 8:
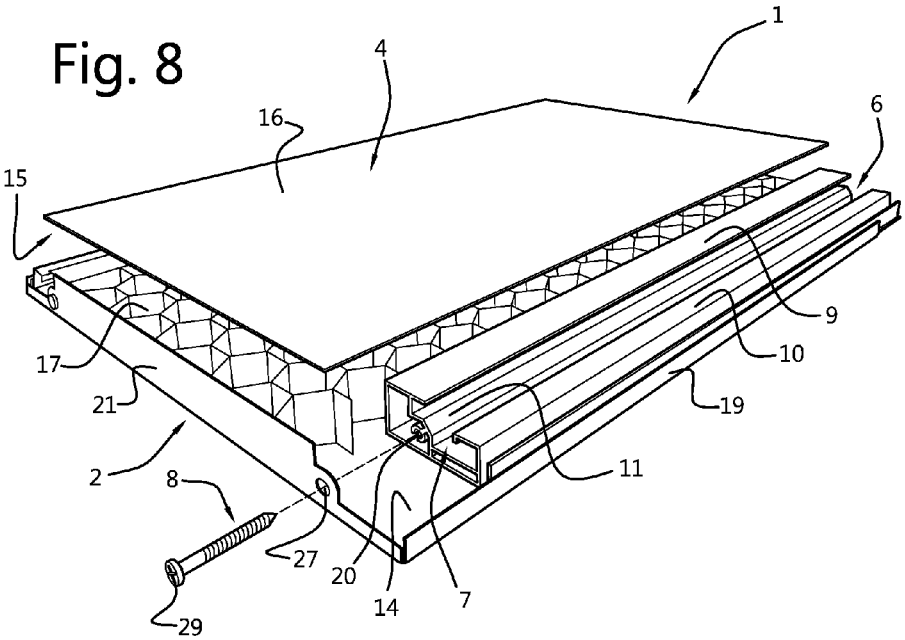
FIG. 8 shows the building panel of FIG. 7 in exploded view.

FIGS. 7 and 8 show an alternative embodiment of a building panel 1 in accordance with the present invention, wherein similar components have been denoted with similar reference numerals. This embodiment differs over the previous embodiments in that the first and second plate 2, 4 comprise no apertures. The core structure 17 may be of honeycomb material, as depicted, or be formed of any other suitable material, for example a foamed material, depending on the intended use of the panel 1. The mechanical fastening device comprises a mechanical fastener 8 with a head 29 and a shank that in mounted condition passes through a hole 27 in the side 21 of the first plate 2 and frictionally or threadedly engages a recess 20 provided in the housing 11 of the attachment member 6, so as to mechanically secure the first plate 2 to the attachment member 6 in a similar ways as described above in relation to FIGS. 1 to 5.

Figure 9:
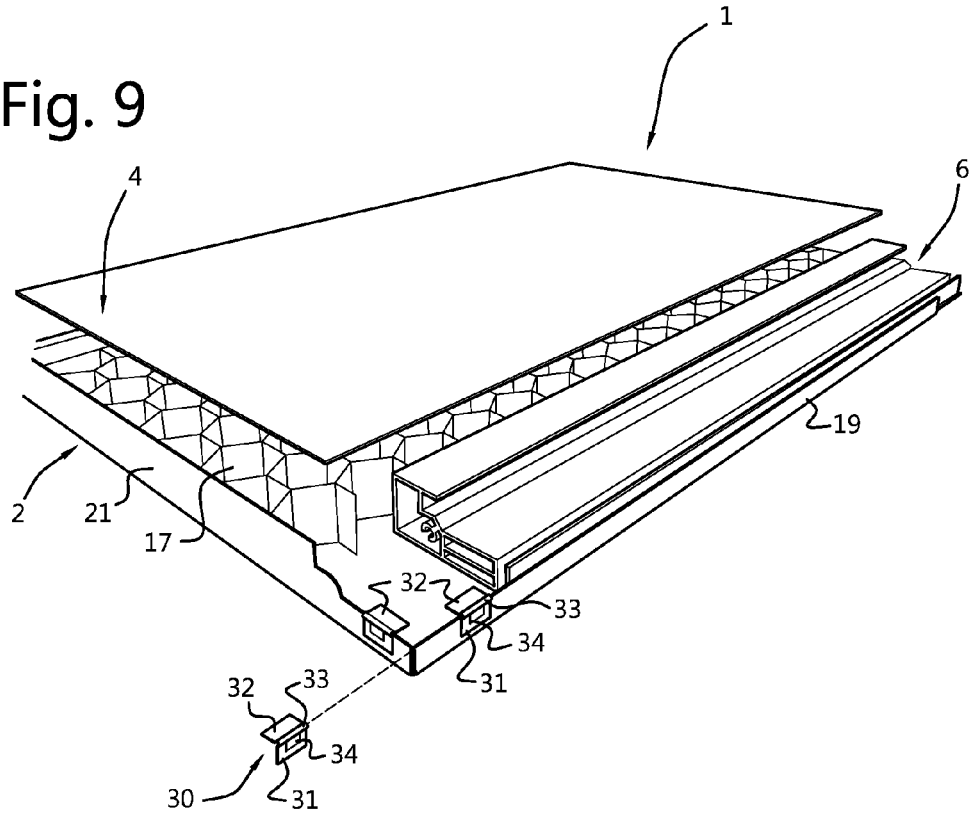
FIG. 9 shows a partial isometric exploded view of a corner of a building panel in accordance with a further embodiment of the present invention.
Figure 10:
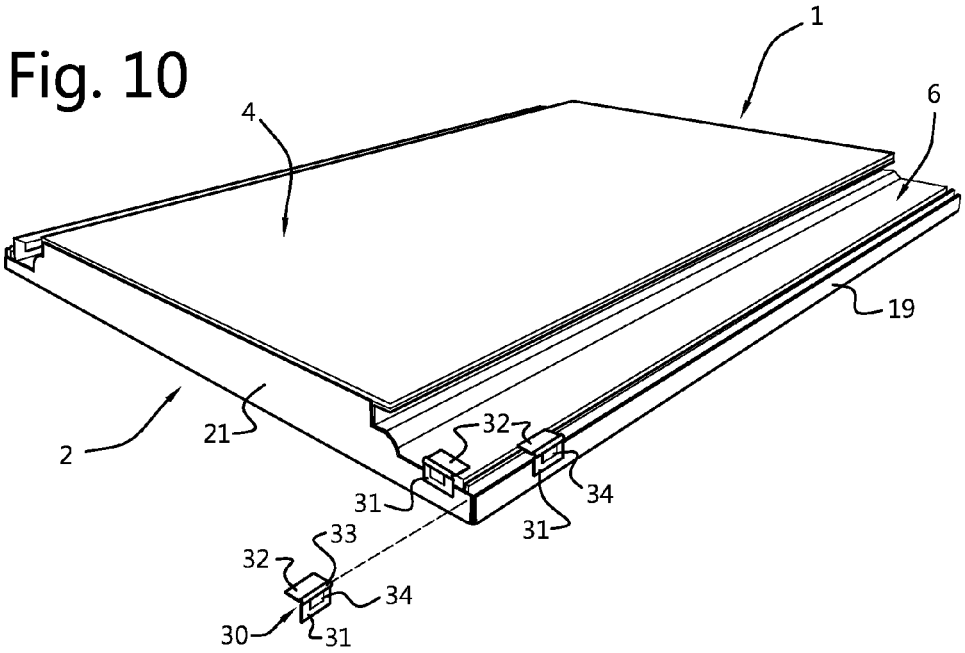
FIG. 10 shows the corner of FIG. 9 in assembled condition.

FIGS. 9 and 10 shows, in exploded and assembled condition respectively, an alternative embodiment of a building panel 1 in accordance with the present invention, wherein similar components have been denoted with similar reference numerals. In this embodiment, the mechanical fastening device comprises a clip 30 with a first leg 31, a second leg 32 extending substantially perpendicular to the first leg 31, and a resilient pinching portion 33 that connects both legs 31, 32 together. In use, this pinching portion can be resiliently clipped around the free edge of the bent side 19 and/or 21 of the first plate 2, with the first leg 31 extending substantially parallel against said side 19, 21, and the second leg 32 projecting inward into the panel 1, over an upper portion of the attachment member 6 (i.e. a side of the attachment member 6 that faces away from the front face 22 of the panel 1). When the adhesive bond between the first plate 2 and the attachment member 6 is disrupted, the first plate 2 will remain suspended to the attachment member 6 by means of the second legs 32, hooking around said attachment member 6. To enhance the mechanical connection between the clip 30, and the first plate 2, the first leg 31 may be provided with one or more barbs 34 that bite into the sides 19, 21, once installed. In the illustrated embodiment, two clips 30 are provided per corner, thus a total number of eight clips 30 per panel 1. This number can be increased or reduced. Several clips 30 may for instance be provided at evenly spaced intervals along the length of the bent sides 19 and/or 21. In an alternative embodiment (not shown), the clips 30 may be replaced by tongues 32' that are integrally formed with the first plate 2 and after assembly of the first plate 2 to the attachment member 6 are bent inward, across the upper side of the attachment member 6, so as to fulfil the same function as the second legs 32 of the clips 30. As with the other embodiments, the first and/or second plate 2, 4 may or may not be provided with apertures 3, 5 and the core structure may for instance comprise a honeycomb material, as depicted, or any other suitable material.

Figure 11:
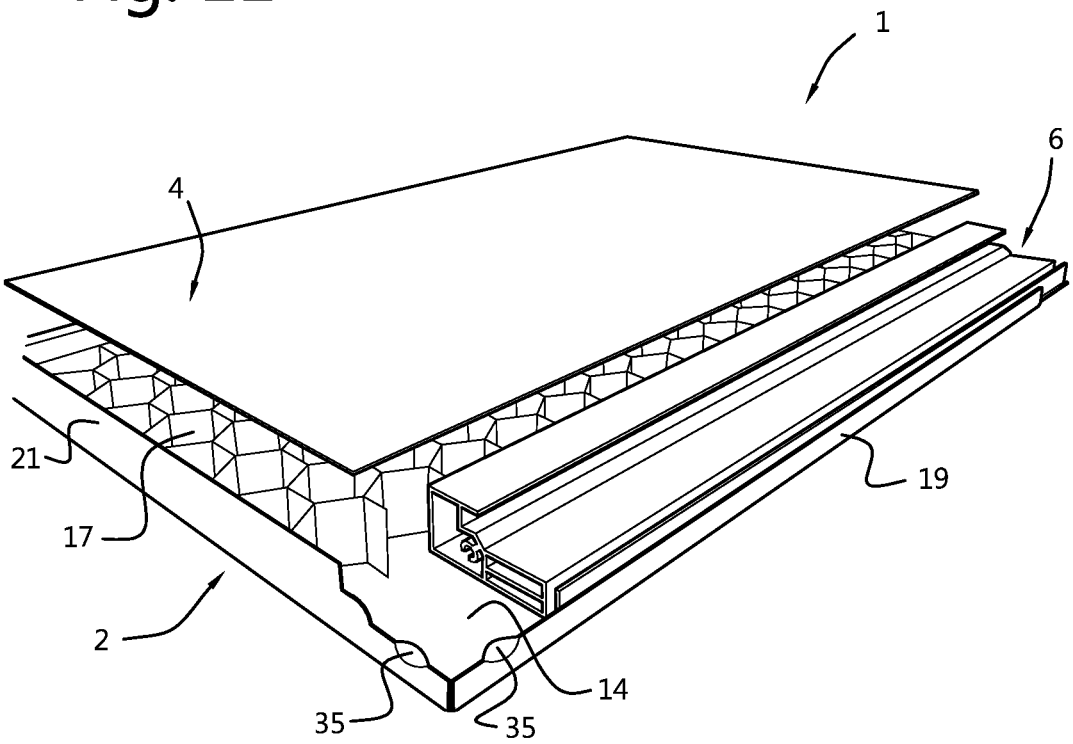
FIG. 11 shows a partial isometric exploded view of a corner of a building panel in accordance with a further embodiment of the present invention.

FIG. 11 shows an alternative embodiment of a building panel 1 in accordance with the present invention, wherein similar components have been denoted with similar reference numerals. In this embodiment, the mechanical fastening device comprises local deformations 35 that are provided in the bent side 19 and/or side 21 of the first plate 2, for example near the corners of the panel 1. In assembled condition, these deformations 35 hook around the upper side of the attachment member 6 (e.g. the side facing away from the front face 22 of the panel 1) in a similar way as the second leg 32 of the clip 30 of the embodiment according to FIGS. 9 and 10, thus ensuring that the second plate 2 remains mechanically secured to the attachment member 6 when the adhesive bonding between said components fails. This embodiment is particularly advantageous in that no additional material or components are needed to fasten the first plate 2 mechanically to the attachment member 6. In the illustrated embodiment, two deformations 35 are provided per corner, so a total number of eight deformations 35 per panel 1. Of course, it is possible to provide the first plate 2 with more or less deformations 35. The deformations 35 may for instance be provided at evenly spaced intervals along the length of the bent sides 19 and/or 21. As with the previous embodiments, the first and/or second plate 2, 4 may or may not be provided with apertures 3, 5 and the core structure may for instance comprise a honeycomb material, as depicted, or any other suitable material.

The invention claimed is:

1. A building panel for a wall or ceiling comprising:

a first plate forming a front face of the panel, said first plate having a first lateral edge, said first plate being bent so as to form a first face of said first plate disposed along said front face of the panel and at least one first side face of said first plate disposed along a side face of the panel, said at least one first side face being defined by a sidewall portion of said first plate extending substantially perpendicular to said first face of said first plate;

a second plate disposed along a rear face of the panel, said second plate having a first lateral edge offset from said first lateral edge of said first plate;

a core structure positioned between said first plate and said second plate and being adhesively bonded to at least one of said first plate or said second plate; and an attachment member including a rearward-facing attachment portion, said rearward-facing attachment portion exposed along said rear face of the panel at a location between said first lateral edges of said first and second plates, said attachment portion defining attachment structure configured to attach to at least one of a wall, a ceiling, or a structure attached to at least one of a wall or ceiling;

wherein:

a local deformation is defined in said sidewall portion of said first plate; and said local deformation extends inwardly from said at least one first side face of said first plate such that a portion of said local deformations extends over an adjacent portion of said attachment member.

2. A building panel according to claim 1, wherein said attachment member is adhesively bonded to an interior surface of said first plate.

3. A building panel according to claim 2, wherein:

said second plate has a second lateral edge opposite said first lateral edge of said second plate and defines a length therebetween;

said first plate has a second lateral edge opposite said first lateral edge of said first plate and defines a length therebetween; and the length of said second plate is less than the length of said first plate such that said second plate does not extend fully over said attachment member along said rear face of the panel.

4. A building panel according to claim 1, wherein said attachment structure of said attachment member extends in a depth-wise direction perpendicular to said front face of the panel between said first lateral edge of said first plate and said first lateral edge of said second plate.

5. A building panel according to claim 1, wherein said attachment structure of said attachment member comprises slots or grooves configured to receive a structure of an attachment device located on at least one of a wall, a ceiling, or a structure that is suspended from or attached to at least one of a wall or ceiling.

6. A building panel according to claim 1, wherein at least one of said first plate or said second plate has a plurality of apertures formed therethrough.

7. A building panel according to claim 1, wherein:

said attachment member includes a first face adjacent said first plate and a second face offset from said first face and positioned closer to said second plate than said first plate;

said attachment member defines a groove between said first face and said second face in a depth-wise direction perpendicular to said first plate, and said groove is open along said rear face of the panel; and said attachment structure of said attachment member is disposed within said groove.

8. A building panel for a wall or ceiling comprising:

a first plate forming a front face of the panel, said first plate having a first lateral edge;

a second plate disposed along a rear thee of the panel, said second plate having a first lateral edge offset from said first lateral edge of said first plate;

a core structure positioned between said first plate and said second plate and being adhesively bonded to at least one of said first plate or said second plate;

an attachment member including a rearward-facing attachment portion, said rearward-facing attachment portion exposed along said rear face of the panel at a location between said first lateral edges of said first and second plates, said attachment portion defining attachment structure configured to attach to at least one of a wall, a ceiling, or a structure attached to at least one of a wall or ceiling; and a mechanical fastening device fastening said first plate to said attachment member;

wherein said mechanical fastening device extends through a portion of said first plate and into an opening defined by said attachment member such that said mechanical fastening device engages said attachment member at said opening.

9. A building panel according to claim 8, wherein:

said first plate is bent so as to form a first face of said first plate disposed along said front face of the panel and at least one first side face of said first plate disposed along a side face of the panel and extending in a plane substantially perpendicular to said first face; and said mechanical fastening device extends through said portion of said first plate defined along said at least one first side face.

10. A building panel according to claim 9, wherein:

said at least one first side face is defined by a sidewall portion of said first plate; and said mechanical fastening device is a mechanical fastener that-fastens said portion of said first plate to said attachment member.

11. A building panel according to claim 8, wherein said mechanical fastening device includes at least one of a pin, screw, rivet, nail, or peg.

12. A building panel according to claim 8, wherein at least one of said first plate or said second plate includes at least one layer of nonwoven fabric or foil.

13. A building panel according to claim 12, wherein at least one of said first plate or said second plate includes at least one layer of said foil bonded to an interior surface thereof, said foil comprises a micro perforated foil.

14. A building panel according to claim 8, wherein said core structure comprises a honeycomb material or a foamed material.

15. A building panel according to claim 8, wherein said mechanical fastening device is arranged to extend along one or more sides of the panel other than said front face of the panel, such that said mechanical fastening device is not visible to a viewer looking at said front face of the panel.

16. A building panel according to claim 8, wherein said mechanical fastening device comprises a threaded portion configured to threadably engage said attachment member within said opening.

17. A building panel according to claim 16, wherein said opening defines a complementary threaded portion configured to receive said threaded portion of said mechanical fastening device.

18. A building panel according to claim 8, wherein said opening defined by said attachment portion is sized to receive and grip said mechanical fastening device.

19. A building panel according to claim 18, wherein said mechanical fastening device comprises a smooth shank portion configured to be received within said opening.

20. A building panel according to claim 8, wherein an opening is defined through said portion of said first plate for receiving said mechanical fastening device.

21. A building panel according to claim 8, wherein:

said opening is defined by a housing of said attachment member extending along a longitudinal direction of said attachment member; and said opening extends in the longitudinal direction along a length of said attachment member.

22. A building panel according to claim 21, wherein:

said length of said attachment member is defined between a first longitudinal end of said attachment member and a second longitudinal end of said attachment member;

said mechanical fastening device is received within said opening at said first longitudinal end of said attachment member; and a second mechanical fastening device is received within said opening at said second longitudinal end of said attachment member.

23. A building panel for a wall or ceiling comprising:

a first plate forming a front face of the panel and having a first lateral edge, a second lateral edge, and defining a first length therebetween;

a second plate offset from said first plate and positioned along a rear face of the panel, said second plate having a first lateral edge, a second lateral edge, and defining a second length therebetween, said second length of said second plate being less than said first length of said first plate;

a core structure positioned between said first plate and said second plate;

a pair of attachment members for attaching the panel to at least one of a wall, a ceiling, or a structure attached to at least one of a wall or ceiling, a first attachment member of said pair of attachment members being disposed between said first lateral edge of said first plate and said first lateral edge of said second plate and a second attachment member of said pair of attachment members being disposed between said second lateral edge of said first plate and said second lateral edge of said second plate, said pair of attachments members defining respective open-ended channels along said rear face of the panel, each of said open-ended channels being open towards said rear face of the panel;

a first mechanical fastener fastening said first plate to at least one of said second plate or said first attachment member; and a second mechanical fastener fastening said first plate to at least one of said second plate or said second attachment member.

24. A building panel according to claim 23, wherein at least one of said first mechanical fastener or said second mechanical fastener comprises at least one of a pin, screw, rivet, nail, or peg.

25. A building panel for a wall or ceiling comprising:

a first plate forming a front face of the panel, said first plate having a first lateral edge;

a second plate disposed along a rear face of the panel, said second plate having a first lateral edge offset from said first lateral edge of said first plate;

a core structure positioned between said first plate and said second plate and being adhesively bonded to at least one of said first plate or said second plate;

an attachment member including a rearward-facing attachment portion, said rearward-facing attachment portion exposed along said rear face of the panel at a location between said first lateral edges of said first and second plates, said attachment portion defining attachment structure configured to attach to at least one of a wall, a ceiling, or a structure attached to at least one of a wall or ceiling; and a mechanical fastening device fastening said first plate to at least one of said second plate or said attachment member;

wherein said mechanical fastening device comprises a wire which extends between said first plate and said second plate and which is looped through apertures in said first and second plates to mechanically fasten said first plate to said second plate.

* * * * *